United States Patent [19]

Hiraoka et al.

[11] 4,348,232

[45] Sep. 7, 1982

[54] ABRASION RESISTANT FERRO-BASED SINTERED ALLOY

[75] Inventors: Takeshi Hiraoka, Ageo; Shigeru Urano, Omiya; Masajiro Takeshita, Yono; Keiji Nakamura, Funabashi, all of Japan

[73] Assignee: Nippon Piston Ring Co., Ltd., Tokyo, Japan

[21] Appl. No.: 147,452

[22] Filed: May 7, 1980

[30] Foreign Application Priority Data

May 7, 1979 [JP] Japan ..... 54-54746

[51] Int. Cl.[3] ..... B22F 3/12

[52] U.S. Cl. ..... 75/238; 75/236; 75/237; 75/241

[58] Field of Search ..... 75/203, 204, 123 D, 75/123 J, 126 F, 126 K, 239; 428/550

[56] References Cited

U.S. PATENT DOCUMENTS 3,698,877 10/1972 Motoyoshi ..... 75/211

4,243,414 1/1981 Takahashi ..... 75/244

*Primary Examiner*—L. Dewayne Rutledge

*Assistant Examiner*—J. J. Zimmerman

*Attorney, Agent, or Firm*—Sughrue, Mion, Zinn, Macpeak & Seas

[57] ABSTRACT

An abrasion resistant ferro-based sintered alloy comprising 0.8 to 1.5% by weight of carbon, 0.5 to 2.5% by weight of chromium, 2.0 to 6.0% by weight of molybdenum, 1.5 to 5.0% by weight of nickel, 0.1 to 2.0% by weight of tungsten, 0.2 to 5.0% by weight of copper and the balance iron wherein said alloy contains molybdenum particles around which nickel is distributed and which are uniformly dispersed in the base structure comprising a mixture of pearlite, bainite and martensite and said alloy contains composite carbide of Fe-Cr-W-C dispersed in the base structure, is disclosed.

2 Claims, 2 Drawing Figures

ABRASION RESISTANT FERRO-BASED SINTERED ALLOY

BACKGROUND OF THE INVENTION

1. Field of the Invention

The present invention relates to abrasion resistant ferro-based sintered alloy for use as abrasion resistant members of internal combustion engines, more particularly, those members which require thermal resistance, corrosion resistance and abrasion resistance simultaneously such as valve seats, valves, etc. and other slidable members.

2. Description of the Prior Art

Conventional abrasion resistant ferro-based sintered alloys comprise various carbides and alloy particles dispersed in pearlite or martensite matrix or substrate or those treated by lead impregnation, sulfur impregnation or steam treatment to improve abrasion resistance and compatibility with other members with which they are employed in a slidable contact.

These materials comprise various elements introduced in large amounts in a form of alloy powder, powder mixture or single powder of the elements. The addition of the elements often causes a problem since these elements, in particular cobalt, are available only with difficulty.

Further, members to be used under the conditions of high temperatures and high loads tend to suffer various drawbacks, for example, lead will be fused and flow out when the alloy impregnated with lead is used, the hardness of those members subjected to steam treatment will be too high and the material will become brittle. In addition, productivity is decreased by the addition of production steps when such treatments are effected.

It is, therefore, strongly desired that alloy comprising as small as possible an amount of useful additive elements but exhibiting excellent thermal resistance, corrosion resistance and abrasion resistance be developed to thereby save natural resources as well as improve productivity.

SUMMARY OF THE INVENTION

A primary object of the present invention is to eliminate the drawbacks involved in the prior arts and provide an alloy having excellent thermal resistance, corrosion resistance and abrasion resistance.

Another object of the present invention is to provide ferro-based alloy comprising a small amount of alloy element to thereby reduce production cost thereof.

Still another object of the present invention is to provide an alloy suitable for members such as valves, valve seats, etc. in internal combustion engines which are being employed under serious conditions, e.g., at high temperatures and under high loads.

As a result of extensive research is attained the present invention which provides an abrasion resistant ferro-based sintered alloy comprising 0.8 to 1.5% by weight of carbon, 0.5 to 2.5% by weight of chromium, 2.0 to 6.0% by weight of molybdenum, 1.5 to 5.0% by weight of nickel, 0.1 to 2.0% by weight of tungsten, 0.2 to 5.0% by weight of copper and the balance iron wherein the alloy contains molybdenum particles around which nickel is distributed or coating are uniformly dispersed in the base structure comprising a mixture of pearlite, bainite and martensite and alloy particles containing composite carbide of Fe-Cr-W-C dispersed in the base structure.

DETAILED DESCRIPTION OF THE INVENTION

Figure 1:
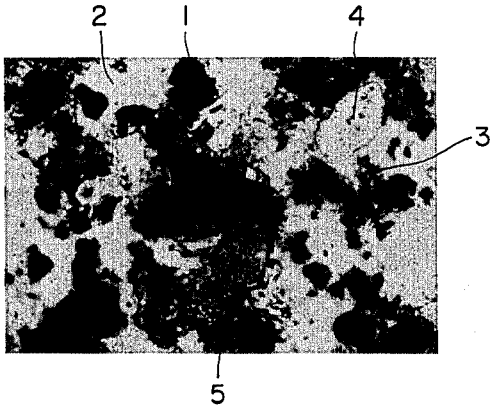
FIG. 1 is a microscopic photograph (200 X) of the sintered alloy of the present invention.

In the sintered alloy of the present invention, ferromolybdenum particles which are effective for providing the alloy with abrasion resistance are uniformly dispersed in the base structure comprising a mixture of pearlite which is tough and bainite and martensite structure which contribute to the hardness of the base structure.

Further, the alloy of the present invention is characterized in that it contains nickel which is effective for improving thermal resistance and corrosion resistance distributed around the particles of ferromolybdenum as well as alloy particles containing composite carbide of Fe-Cr-W-C dispersed in the base structure. The particles distributed in the base structure contribute together to improvement of thermal resistance, corrosion resistance and abrasion resistance of the alloy over the conventional alloy by synergism. Further, they can make the alloy compatible with another member which is in slidable contact therewith.

The activity of the various individual components of the sintered alloy composition of the present invention and the reasons for limiting their amounts are explained below.

Carbon forms a solid solution with iron to form a tough pearlite structure in the base structure. If the amount of carbon is less than 0.8% by weight, the pearlite structure tends to be converted to ferrite which leads to reduction in abrasion resistance. On the other hand, when the amount of carbon is more than 2.0% by weight the content of cementite which render the alloy brittle strongly increases in the base structure resulting in that it degrades strength and machine-ability of the alloy.

Molybdenum, which can be added to the base structure in the form of ferromolybdenum powders, is dissolved partially in the base structure to form a solid solution therewith and the balance remains as is and forms hard ferromolybdenum particles dispersed in the base structure to improve abrasion resistance and strength at high temperatures. Thus, molybdenum is added in order to stabilize the structure of the alloy after sintering. When molybdenum is contained in an amount of less than 2% by weight the content of ferromolybdenum particles is small and abrasion resistance of the resulting alloy is degraded, while the base structure becomes brittle when the amount of molybdenum is more than 6% by weight.

Nickel is effective for toughening the base structure and at the same time for increasing strength of the base structure. In addition, this element contributes to conversion of a part of the base structure to martensitebainite. If the amount of nickel is less than 1.5% by weight the quantity of martensite is so small that no sufficient hardness of the base structure is obtained, on the other hand when more than 5.0% by weight of nickel is used the amount of martensite is too excessive to prevent the alloy from becoming brittle. Therefore, the suitable amount of nickel is selected to be 1.5 to 5.0% by weight.

Chromium is dispersed in the base structure as alloy particles containing composite carbide of Fe-Cr-W-C and contributes to afford the alloy abrasion resistance. A part of chromium, however, forms a solid solution with the base material to improve the strength of the base structure. The amount of chromium is limited to 0.5 to 2.5% by weight. This is because the use of less than 0.5% by weight of chromium gives insufficient amount of the composite carbide and thus degraded abrasion resistance, while the use of more than 2.5% by weight of chromium leads to the formation of excessive amount of carbide thereby rendering the alloy brittle.

Tungsten which is dispersed in the base structure as alloy particles of the composite carbide of Fe-Cr-W-C is effective for preventing the carbide from scattering at high temperatures and for stabilizing the base structure. When tungsten is used in an amount of less than 0.1% by weight the carbide becomes unstable, while in an amount of more than 2.0% by weight such effect is not improved but instead the hardness of the carbide is increased more than is necessary. Therefore, the amount of tungsten to be added is limited to 0.1% to 2.0% by weight.

Copper is dispersed in the base structure and is effective for strengthening the base structure. When the amount of copper is less than 0.2% by weight the strength of the base structure is unsatisfactory, while with more than 5.0% by weight of copper the base structure becomes brittle. Thus, the amount of copper is limited to 0.2 to 5.0% by weight.

In a preferred embodiment, the present invention provides an abrasion resistant alloy comprising 0.8 to 1.5% by weight of carbon, 0.5 to 2.5% by weight of chromium, 2.0 to 6.0% by weight of molybdenum, 1.5 to 5.0% by weight of nickel, 0.1 to 2.0% by weight of tungsten, 0.2 to 5.0% by weight of copper, 0.1 to 5.0% by weight of at least one of phosphorus, boron and silicon and the balance iron, wherein the alloy contains molybdenum particles around which nickel is distributed are uniformly dispersed in the base structure comprising a mixture of pearlite, bainite and martensite and also contains alloy particles containing composite carbide of Fe-Cr-W-C dispersed in the base structure and wherein the alloy has 0.2 to 10% by volume of sintering pores at least 40% of which consist of pores having a pore size of not more than 150 μm.

As stated above, carbon, chromium, molybdenum, nickel tungsten and copper contribute to improvement of hardness, strength and abrasion resistance of the base structure. On the other hand, 0.1 to 5.0% by weight of at least one of phosphorus, boron and silicon is added to permit liquid-phase sintering.

Phosphorus, boron and silicon can decrease the temperature at which liquid-phase appear in inverse proportion to the content thereof and thus permit satisfactory liquid-phase sintering at low temperatures, e.g., not higher than 1,250° C. which will not cause any problem in view of durability of a sintering furnace. Liquid-phase sintering is advantageous since smaller sintering pore size can be obtained and total volume of sintering pores can be reduced resulting in that excellent strength especially when subjected to high planar pressure, pitting resistance and abrasion resistance can be obtained.

The reason for the limiting the amount of phosphorus, boron and/or silicon is as follows. When the amount of at least one of phosphorus, boron and silicon is less than 0.1% by weight, the amount of liquid phase is too small and increase in abrasion resistance is not obtained. On the other hand, when the amount of at least one of phosphorus, boron and silicon is reacter than 5.0% by weight, the amount of liquid-phase becomes too large and a sintered body having a high dimensional accuracy cannot be obtained. For this reason, at least one of phosphorus, boron and silicon is used in an amount of 0.1 to 5.0% by weight.

Regarding the porosity, if the porosity exceeds 10% by volume, sintering is insufficient and the bond strength amongst the particles is weak. Thus, the resulting alloy is susceptible to fatigue and tends to induce pitting wear. Furthermore, its mechanical strength is degraded. Accordingly, porosity is limited to not more than 10% by weight volume. If it is less than 0.2% by volume, there are too few oil pools, and the product has poor retension and is susceptible to scuff wear. The importance of pores is evident from the fact that non-porous material obtained from a solution of the same components cannot give expected properties.

Desirably, the pores are fine and are dispersed uniformly. When the pore size is more than 150 μm and the porosity is less than 10% by volume, the pores are not uniformly present and the oil retension of the product is very poor. Accordingly, for the same reason, scuff wear tends to occur if fine pores having a size of not more than 150 μm are present in an amount of less than 40% by volume.

Referring now to the drawings in detail an example of the sintered alloy of the present invention is shown in FIG. 1 representing a microscopic observation, shown at 200 X magnification, of a sintered alloy structure of the present invention comprising 1.20% by weight of carbon, 3.58% by weight of molybdenum, 3.40% by weight of nickel, 1.0% by weight of chromium, 0.20% by weight of tungsten, 1.30% by weight of copper and the balance iron which was subjected to erosion with a 3% Niter solution. In FIG. 1, the numeral 1 is illustrative of pearlite structure, 2 martensite structure, 3 bainite structure, 4 a ferromolybdenum particle and 5 a composite carbide particle of Fe-Cr-W-C.

As shown in FIG. 1, ferromolybdenum particles and alloy particles containing composite carbide of Fe-Cr-W-C are dispersed or distributed in the base structure comprising a mixture of pearlite, martensite and bainite.

Figure 2:
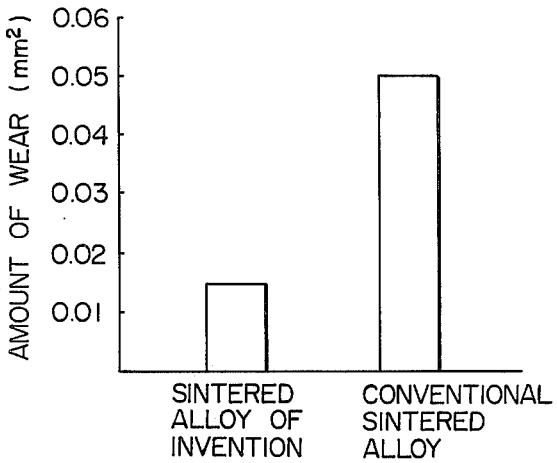
FIG. 2 is a graph showing the abrasion resistance of sintered alloys of the present invention and of the conventional ferro alloy.

FIG. 2 shows the results of measuring abrasion using a valve seat abrasion testing machine under the following conditions.

| | |
|---|---|
| Number of Rotation: | 3,000 r.p.m. |
| Test Repeating Number: | $8 \times 10^5$ |
| Valve Velocity at the Time of Valve Closing: | 0.5 m/sec. |
| Spring Pressure: | 35 kg |
| Number of Valve Rotation: | 8–10 r.p.m. |
| Heating: | Combustion of a mixture of propane and air |
| Test Temperature: | 300° C. |
| Composition of Counter-part Valve: | Stellite-covered |

Test Sample:

1. Sintered Alloy of the Present Invention
   Carbon 1.20%, Copper 1.30%, Nickel 3.40%, Molybdenum 3.58%, Chromium 1.0%, Tungsten 0.20%, and Balance iron (by weight)
   Hardness: Hardness on the Rockwell B scale of 96
   Density: 6.80 g/cm$^2$
2. Conventional Ferro Alloy
   Carbon 1.5%, Molybdenum 4.0%, Chromium 1.5%, Nickel 1.5%, Cobalt 3.5% and Balance iron -continued

| | |
|---|---|
| (by weight) | |
| Base Structure: | Ferromolybdenum particles and chromium carbide were dispersed in pearlite |
| Hardness: | Hardness on the Rockwell B scale of 90 |
| Density: | 6.70 g/cm$^3$ |

FIG. 2 shows the results of the abrasion test and the ordinate indicates the amount of wear of the alloy of the present invention and that of the conventional alloy measured under the same conditions. From the results shown in FIG. 2 it will be apparent that sintered alloy of the present invention exhibits excellent abrasion resistance. The advantage of the alloy of the present invention is believed to be ascribable to synergistic effect obtained by the ferromolybdenum particles having a very high hardness (not less than Hv 1,000) and the alloy particles containing composite carbide of Fe-Cr-W-C. Excellent abrasion resistance of the alloy of the present invention is believed to be provided by the fact that ferromolybdenum particles will not be dropped out when the member made of the alloy is used since they are dispersed in the base structure, the base structure itself is tough and have satisfactory hardness by the effect of martensite-bainite.

The sintered alloy of the present invention is excellent not only in the abrasion resistance and strength as stated above but also in thermal resistance and corrosion resistance because of nickel distributed around the ferromolybdenum particles.

While the invention has been described in detail and with reference to specific embodiments thereof, it will be apparent to one skilled in the art that various changes and modifications can be made therein without departing from the spirit and scope thereof.

What is claimed is:

1. An abrasion resistant ferro-based sintered alloy comprising 0.8 to 1.5% by weight of carbon, 0.5 to 2.5% by weight of chromium, 2.0 to 6.0% by weight of molybdenum, 1.5 to 5.0% by weight of nickel, 0.1 to 2.0% by weight of tungsten, 0.2 to 5.0% by weight of copper and the balance iron wherein said alloy contains molybdenum particles around which nickel is distributed and which are uniformly dispersed in the base structure comprising a mixture of pearlite, bainite and martensite and said alloy contains composite carbide of Fe-Cr-W-C dispersed in the base structure.

2. The alloy of claim 1, wherein said alloy further comprises 0.1 to 5.0% by weight of at least one of phosphorus, boron and silicon which permits liquid-phase sintering and have 0.2 to 10% by volume of sintering pores at least 40% of which consist of pores having a pore size of not larger than 150 μm.

* * * * *